US010374352B2

(12) United States Patent
Willems

(10) Patent No.: US 10,374,352 B2
(45) Date of Patent: Aug. 6, 2019

(54) PATCHBOARD

(71) Applicant: Phoenix Contact GmbH & Co. KG, Blomberg (DE)

(72) Inventor: Marcel Willems, Blomberg (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 16/091,561

(22) PCT Filed: Apr. 6, 2017

(86) PCT No.: PCT/EP2017/058263
§ 371 (c)(1),
(2) Date: Oct. 5, 2018

(87) PCT Pub. No.: WO2017/174728
PCT Pub. Date: Oct. 12, 2017

(65) Prior Publication Data

US 2019/0109404 A1 Apr. 11, 2019

(30) Foreign Application Priority Data

Apr. 8, 2016 (DE) ..... 10 2016 106 481

(51) Int. Cl.
*H01R 13/502* (2006.01)
*H01R 13/514* (2006.01)

(52) U.S. Cl.
CPC ..... *H01R 13/514* (2013.01)

(58) Field of Classification Search
CPC . H01R 13/514; H01R 13/4223; H01R 9/2408
USPC ..... 439/701, 594, 717
See application file for complete search history.

(56) References Cited

U.S. PATENT DOCUMENTS 4,611,879 A 9/1986 Bullard
5,295,870 A 3/1994 Rei et al.
6,168,461 B1 * 1/2001 Chang ..... H01R 9/2408 439/540.1
6,193,550 B1 * 2/2001 Yamashita ..... H01R 13/514 439/594

(Continued)

FOREIGN PATENT DOCUMENTS

DE 19512226 A1 10/1996
DE 19519634 A1 12/1996

(Continued)

*Primary Examiner* — Phuong Chi T Nguyen
(74) *Attorney, Agent, or Firm* — David S. Safran; Roberts Mlotkowski Safran Cole & Calderon, P.C.

(57) ABSTRACT

A patchboard having at least four socket blocks and at least one fastening element, wherein the individual box-shaped socket blocks are arranged in relation to each other in such a way that each socket block is connected to at least one further socket block in both x and y directions, end and side faces of the socket blocks each have at least one connection region for connecting to another socket block. A fastening element is arranged in the center between four socket blocks and is a pin having a gear-shaped cross-section having four ridge-shaped teeth, a groove being formed on each of the four longitudinal edges of the individual socket blocks, which grooves have a first section and at least one second section adjoining the first section. The pin can be rotated about its longitudinal axis when the pin is arranged in the second section of the grooves.

7 Claims, 12 Drawing Sheets

(56) References Cited

U.S. PATENT DOCUMENTS

| | | | | |
|---|---|---|---|---|
| 6,332,813 | B1 * | 12/2001 | Okabe | H01R 13/514 439/541.5 |
| 6,375,517 | B1 * | 4/2002 | Okabe | H01R 13/514 439/594 |
| 6,656,086 | B2 | 12/2003 | Yeo | |

FOREIGN PATENT DOCUMENTS

| | | | |
|---|---|---|---|
| DE | 102008015554 | A1 | 10/2009 |
| DE | 102014101528 | A1 | 8/2015 |
| EP | 0170455 | A2 | 2/1986 |
| EP | 0341864 | A1 | 11/1989 |
| EP | 1091380 | A1 | 4/2001 |
| WO | 2016162464 | A1 | 10/2016 |

* cited by examiner

PATCHBOARD

BACKGROUND OF THE INVENTION

Field of the Invention

The invention relates to a patchboard with several socket blocks and at least one fastening element, the individual socket blocks being arranged relative to one another such that each socket block is connected to at least one other socket block both in the x direction and also in the y direction, the individual socket blocks each having a box-shaped housing with two end faces and four side faces which extend between the end faces, and the two end faces of the socket blocks, each having at least one connection region.

Description of Related Art

To connect electrical leads, for decades electrical terminal blocks have been used of which several are generally latched next to one another on a mounting rail, several mounting rails which are equipped in this way with terminal blocks often being located in a control cabinet. Since a relatively large amount of space remains unused between the individual mounting rails, in particular where a plurality of electrical leads must be connected in a very narrow space, patchboards are often used. For this purpose, patchboards are known from practice in which within a fixed rectangular mounting frame there are a plurality of socket blocks in corresponding chambers of the frame. Electrical leads can be connected to the patchboard or individual socket blocks both from the front, the field side, and also from the back, the station side. To do this, in the box-shaped housings of the individual socket blocks there are connecting elements which are generally connected to one another via corresponding conductor bars so that an electrical lead which has been inlet through a corresponding lead inlet opening in the front end face can be electrically joined to an electrical lead or a terminal contact which has been inlet through a corresponding inlet opening in the rear end face of the housing.

For example, German Patent application DE 195 12 226 A1 discloses one such patchboard with a plurality of socket blocks. In the patchboard disclosed in this document, the individual socket blocks which have been inserted in the individual chamber of the mounting frame all have the same dimensions. On their upper and lower edge side, a respective mounting flange tongue is tightly joined to the patchboard, via which the patchboard can be fastened by means of screws on a mounting frame. It is not possible to adapt the patchboard to individual wishes of the user in this known patchboard. If the number of leads to be connected has to be increased, a correspondingly larger patchboard with a larger number of individual socket blocks must be used, in practice patchboards with 18, 32, 48, 54 or 80 socket blocks being available.

German Patent Application DE 10 2014 101 528 A1 discloses a patchboard which is characterized by increased flexibility and the possibility of adapting the patchboard to individual wishes. This is achieved by the individual side faces of the socket blocks each having at least one locking element for connecting to another socket block. The locking elements which are made on opposing side faces are made and arranged correspondingly to one another so that the socket blocks can be directly connected to one another. In this way the use of a rigid mounting frame which fixes the number of individual socket blocks can be eliminated so that the patchboard can fundamentally have any number of socket blocks.

The socket blocks known from DE 10 2014 101 528 A1 on their individual side faces have drop-in pins which can be inserted into corresponding latch holes on the opposite side faces of an adjacent socket block. Moreover, the socket blocks each have two catch hooks on a side face which can be hooked into longitudinal latch holes which are made on the opposing side face. Both the drop-in pins and also the catch hooks extend perpendicular to the longitudinal extension of the respective side face so that the patchboard must be dismounted line by line or column by column. After connecting the individual socket blocks, a very stable patchboard which enables signal distribution on an extremely small space is provided.

A patchboard in which likewise the use of a mounting rail can be abandoned is also disclosed in DE 35 87 796 T2 and corresponding U.S. Pat. No. 4,611,879. In this patchboard on which this invention is based, on the side faces of the individual socket blocks several ridges are made to which on the opposite side face of the socket blocks there are corresponding grooves. The ridges and grooves each run parallel to the longitudinal ex tension of the respective side face, i.e. in the extension direction from one end face to the other end face. Two socket blocks which are located next to one another can thus be easily connected by the ridges on the side face of one socket block being inserted into the corresponding grooves on the opposite side face of the other socket block. Projections made on the grooves provide for two socket blocks not being able to be displaced against one another in the longitudinal direction of the side faces after connecting.

In order to reliably connect to one another, two socket blocks which have been connected in this way, in the known patchboard there are separate fastening elements in the form of interlocking wedges which are pushed into a recess which is made between two connected patchboards. To form the recess, in their side faces the socket blocks have notches which are opposite one another and which are made dovetailed. The interlocking wedge has a bilaterally dovetailed cross section corresponding thereto. Moreover, on a front end of the interlocking wedge, a catch hook is made which provides for latching of the interlocking wedge in the recess when it has been pushed fully into the recess between two socket blocks.

In the patchboard known from the prior art, the locking elements made on the individual socket blocks optionally together with separate fastening elements provide for a reliable and stable connection of the individual socket blocks to one another so that a stable patchboard is formed without a corresponding mounting frame being necessary. But the disadvantage is that due to the completed latching of the individual socket blocks with one another dismounting of the patchboard is either not possible at all or is only possible with increased effort. The dismounting of a socket block which is not located directly on the edge of the patchboard is as poorly possible as the insertion of a new socket block within the patchboard so that the replacement of individual defective socket blocks is not possible or is possible only with increased effort.

SUMMARY OF THE INVENTION

Therefore, the object of this invention is to provide a patchboard with several socket blocks in which, even in the assembled state, individual socket blocks can be removed from the patchboard with little effort. In doing so, the patchboard will have increased stability overall.

This object is achieved in a patchboard with the features of the invention in that the patchboard has at least one fastening element which is located in the center between four socket blocks, the fastening element being made as a pin which has a gear-shaped cross section with four ridge-shaped teeth which run in the direction of the longitudinal axis of the pin.

In contrast to the wedge-shaped fastening element which is known from German Patent application DE 35 87 796 T2 and corresponding U.S. Pat. No. 4,611,879 which is used for connection of two socket blocks which are located next to or on top of one another, in the patchboard in accordance with the invention, the pin is made as a fastening element and is arranged such that it is used to connect a total of four socket blocks to one another. Since the pin is located in the middle between four socket blocks for this purpose, in the patchboard in accordance with the invention recesses corresponding to the pin are not made in the side faces, but on the longitudinal edges of the individual socket blocks.

In accordance with the invention, on the four longitudinal edges of the individual socket blocks one groove at a time is formed which has a first section and at least one second section which adjoins it in the longitudinal extension of the longitudinal edge, the length of the second section corresponding at least to the length of the pin. Moreover, the cross section of the individual grooves in the first section corresponds to a one quarter segment of the cross section of the pin, while the cross section of the individual groove in the second section is so large that the pin can be turned around its longitudinal axis when it is located in the second section of the respective groove of the four socket blocks.

In the patchboard in accordance with the invention, the opening into which the pin is inserted as a fastening element is thus formed between the facing longitudinal edges of four socket blocks which are located around the opening. The shape of the grooves in the longitudinal edges in the first section is made such that the cross section of the individual groove each corresponds to a respective one quarter segment of the cross section of the pin so that the cross section of the four grooves together corresponds to the cross section of the gear-shaped pin. Therefore, the pin can be easily inserted into the opening which has been formed in this way between the four socket blocks.

Since the respective groove on the longitudinal edges in the first section has a cross section which corresponds to a quarter segment of the cross section of the gear-shaped pin, the shape of the grooves diverges from a quadrant by a ridge which engages the empty space between two adjacent teeth of the pin being made on the longitudinal edges when the pin is located in a first section of the grooves.

In the patchboard in accordance with the invention, the socket blocks which are located adjacent to one another are connected first of all via the connecting elements which are made on the side faces of the socket blocks. Further, fastening of the socket blocks which are connected to one another in this way takes place via the gear-shaped pin when the latter is located in the second section of the grooves and is turned there around its longitudinal axis such that the pin in this orientation can no longer be pushed through the first section of the grooves. The orientation of the teeth of the pin then no longer corresponds to the gear-shaped opening made in the center between the four socket blocks so that the socket blocks can no longer be displaced in the direction in which the pin has been inserted between the socket blocks.

In order to prevent displacement of the socket blocks which are joined to one another via the connecting elements not only in the insertion direction of the pin, but also opposite the insertion direction of the pin, corresponding stops or edges can be made on the individual catch elements, as are also provided fundamentally tor the ridges and grooves of the socket blocks known from DE 35 87 796 T2 and corresponding U.S. Pat. No. 4,611,879. But preferably, the formation of these stops or edges is omitted so that the individual socket blocks can be mounted not only in one direction. In order to then also prevent shifting of the socket blocks relative to one another parallel to the longitudinal extension of the respective side faces, the grooves on the longitudinal edges of the individual socket blocks each have a third section which adjoins the second section in the longitudinal extension of the longitudinal edge, the cross section of the individual grooves in the third section, like the cross section of the groove in the first section, corresponding to one quarter segment of the cross section of the pin. A pin which is located in the second section and which has been rotated accordingly around its longitudinal axis then prevents the socket blocks from being able to be shifted relative to one another in the direction of the longitudinal axis of the pin.

According to one especially preferred configuration of the patchboard, the teeth of the pin are made dovetailed in cross section. Mechanical connections which are formed by a dovetailed tongue and a dovetailed groove have the advantage that they can be easily mounted and dismounted and are nevertheless able to accommodate relatively large forces. Forming the teeth of the pin with a dovetailed cross section thus results in that, via the pin, not only is displacement of the individual socket blocks in the direction of the longitudinal extension of the side faces or of the pin prevented, but moreover, also additional fastening of the socket blocks to one another takes place perpendicular to the longitudinal extension of the side faces, therefore in the x direction and in the y direction.

According to another especially advantageous configuration of the invention, on each side face of the socket blocks, at least one groove and at least one ridge corresponding to the groove are made, the ridges and the grooves each preferably having a dovetailed cross section. The at least one groove on one side face of a socket block is arranged mirror symmetrically to the ridge on the opposite side face of the socket block so that when two socket blocks are joined to one another, a respective ridge on one side face of a socket block engages a corresponding groove on the opposite side face of another socket block. At the same time, a respective groove on one side face of one socket block together with a ridge on an opposite side face of the other socket block forms a corresponding mechanical connection. Between two interconnected socket blocks there are then at least two connections, in particular at least two tongue-in-groove connections.

If the individual connecting elements in the peripheral direction of the individual socket blocks each have the same distance to one another, individual socket blocks can also be joined to one another via the connecting elements which correspond to one another even if the socket blocks are turned by 90° around their center axis. Each side face of one socket block can then be connected to any side face of another socket block.

So that a pin which is located in the second section of the grooves of four adjacent socket blocks, which grooves together form the opening for the pin, does not turn unintentionally, preferably latching between the pin and the housings of the socket blocks is formed. According to one configuration of the invention, on at least one tooth of the pin on one front end a catch recess is made and on the front end of the first section of the groove facing the second section a corresponding catch projection is made which engages the catch recess when the pin is turned into its interlocking position. Preferably, on all four teeth of the pin, there is a corresponding catch recess, specifically on both front ends, then also on the front end of the third section of the respective groove facing the second section a corresponding catch projection being made on the individual socket blocks. It is apparent to one skilled in the art here that the arrangement of the catch recesses and the catch projections can also be interchanged so that on the teeth of the pin catch projections and on the front ends of the first section and/or of the third section of the groove corresponding catch recesses are made.

In order to be able to easily push the pin into the opening between the socket blocks and in particular to be able to turn it around its longitudinal axis in the region of the center second section of the grooves, the tip of a conventional screwdriver can be used. For this purpose, in the front end of the pin a recess is preferably made into which the tip of a screwdriver can be inserted.

In particular, there is at this point a host of possibilities for configuring and developing the patchboard in accordance with the invention as will be apparent from the following description of preferred exemplary embodiments in conjunction with the accompanying drawings.

DETAILED DESCRIPTION OF THE INVENTION

Figure 1A:
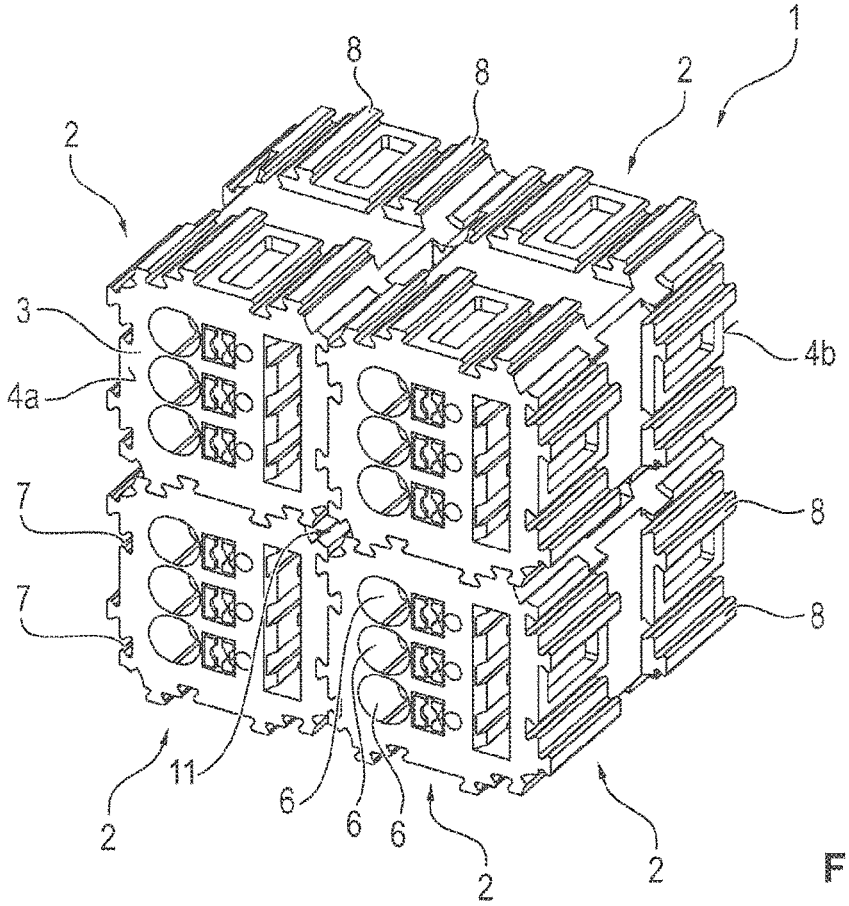
FIG. 1 a frontal perspective view of an exemplary embodiment of a patchboard composed of four socket blocks.
Figure 1B:
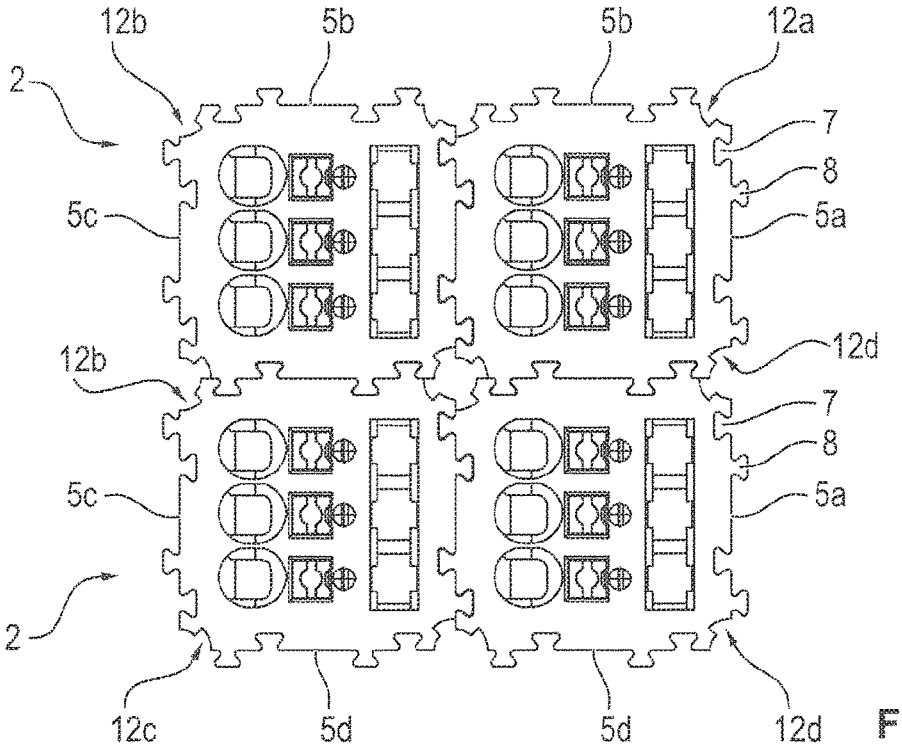

FIG. 1 shows one exemplary embodiment of a patchboard 1 which comprises four socket blocks 2, the individual socket blocks 2 being directly joined to one another. As is apparent from the exemplary embodiment according to FIGS. 11 and 12, the patchboard 1 can also be composed of considerably more socket blocks 2, the individual socket blocks 2 being arranged relative to one another such that each socket block 2 is or at least can be joined to at least one further socket block 2 both in the x direction and also in the y direction.

The individual socket blocks 2 each have a box-shaped housing 3 with two end faces 4*a*, 4*b* and four side faces 5*a*, 5*b*, 5*c* and 5*d*. Here, the individual side faces 5*a*, 5*b*, 5*c*, 5*d* extend between the two end faces 4*a*, 4*b* and each have an angle of 90° relative to the end faces 4*a*, 4*b*. A socket block 2 thus has an essentially rectangular cross section, here the individual socket blocks 2 are square, but the invention is not limited thereto. Moreover, the socket blocks 2 have a length and a depth which runs in the longitudinal direction of the respective side faces 5*a*, 5*b*, 5*c*, 5*d* and thus in the z direction.

On each end face 4*a* of the socket blocks 2 there are three connection regions 6 which are made preferably as spring force clamp terminals. Within the housing 3 there are then three clamping springs, by means of the clamping springs a stripped lead inlet through a respective lead inlet opening of a connection region 6 being clamped against a conductor bar which is likewise located in the housing 3 and thus able to be joined in this way in an electrically conductive manner to the conductor bar. The other end face 4*b* can likewise have three connection regions. However, it is also possible for the two end faces 4*a*, 4*b* to have a different number of connection regions, e.g., the end face 4*b* could have only two connection regions.

To join the socket blocks 2 to one another, the socket blocks 2 on all our side faces 5*a*, 5*b*, 5*c*, 5*d* have several connecting elements. In this way, a socket block 2 on all four side faces 5*a*, 5*b*, 5*c*, 5*d* and thus both in the x direction and also the y direction can be joined to another socket block 2 in order to form a corresponding patchboard 1. In the illustrated exemplary embodiment, the socket blocks 2, as is apparent in particular from the enlargement according to FIG. 3, on each the four side faces 5*a*, 5*b*, 5*c*, 5*d* has two dovetailed grooves 7 and two dovetailed ridges 8. The grooves 7 on one side face 5*a*, 5*b*, 5*c*, 5*d* are arranged mirror symmetrically to the ridges 8 on the opposite side face 5*b*, 5*a*, 5*d*, 5*c* so that, for two interconnected socket blocks 2, the grooves 7 and ridges 8 of one side face 5*b* of one socket block 2 engage the ridges 8 and grooves 7 of the opposite side face 5*a* of the adjacent socket block 2.

Since both the grooves 7 and also the ridges 8 extend parallel to the longitudinal extension of the respective side face 5*a*, 5*b*, 5*c*, 5*d*, joining of two socket blocks 2 to one another takes place by the socket blocks 2 being pushed into one another with their respectively opposite grooves 7 and ridges 8. The mounting direction thus runs parallel to the longitudinal extension of the side faces 5*a*, 5*b*, 5*c*, 5*d*. Thus, the mounting direction also corresponds to the actuating direction of the connection regions 6, i.e., the direction in which the leads to be connected are inserted into the connection regions 6.

For the patchboard 1 which is shown in FIG. 1, the individual socket blocks 2 are joined to one another by the respective dovetailed ridges 8 being inserted into the corresponding grooves 7 to such an extent they can be displaced against one another only in the direction of the longitudinal extension of the side faces 5, i.e., in the z direction. Since the longitudinal extension of all ridges 8 and grooves 7 runs parallel to the longitudinal extension of the respective side face 5*a*, 5*b*, 5*c*, 5*d* and thus in the z direction, the joining of the individual socket blocks 2 to one another and the addition of further socket blocks 2 to an existing patchboard 1 can be done very easily.

Figure 2:
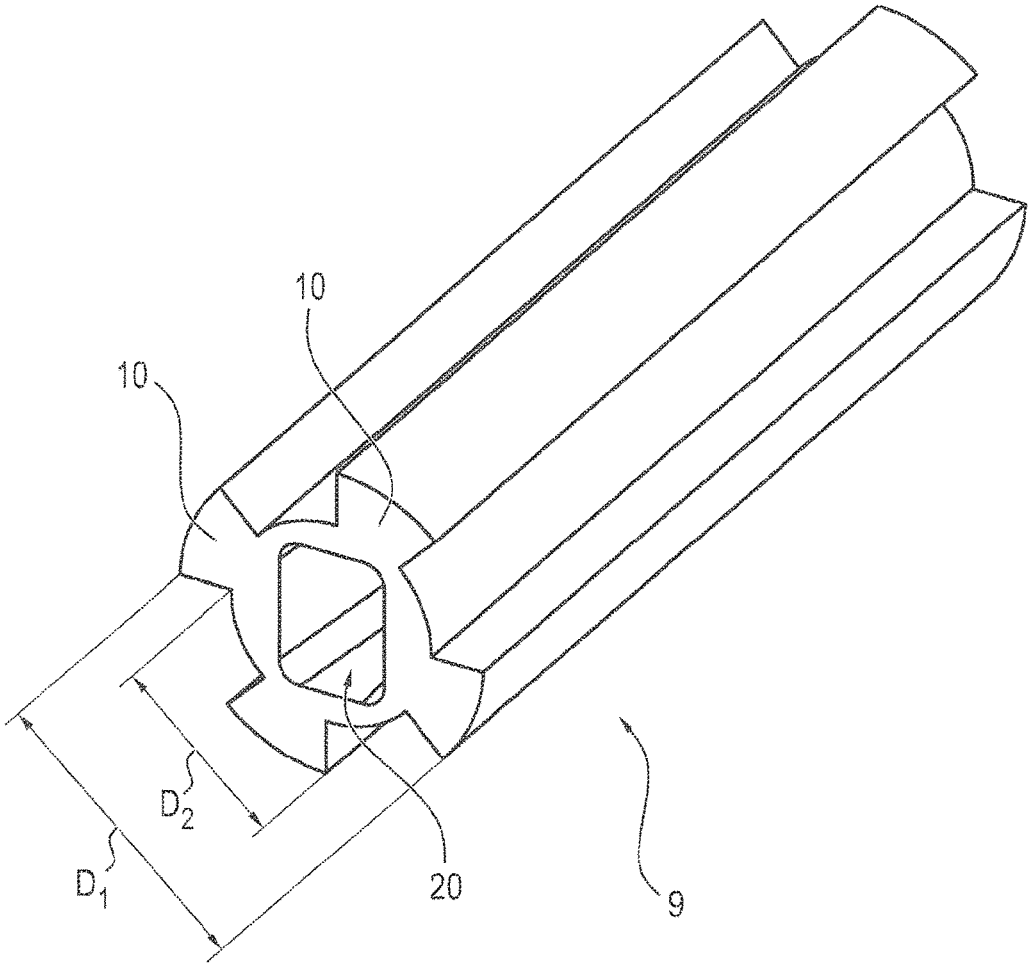
FIG. 2 shows an enlarged view of an exemplary embodiment of a pin for a patchboard according to FIG. 1, FIG. 3 frontal perspective view of an individual socket block of a patchboard.

In order to ensure a secure connection of the individual socket blocks 2 of the patchboard 1 also in the z direction, there is a pin 9 which is shown enlarged in FIG. 2 and which has a gear-shaped cross section with four ridge-shaped teeth 10 which run in the direction of the longitudinal axis of the pin 9. As is apparent from FIG. 2, the teeth 10 of the pin 9 are made dovetailed, i.e., thus have a dovetailed cross section. For insertion of the pin 9, in the center between four socket blocks 2 an opening 11 is made whose cross section corresponds to the cross section of the pin 9, as is especially apparent from FIG. 1*b*. The opening 11 is formed by the four mutually bordering longitudinal edges 12*a*, 12*b*, 12*c*, 12*d* of the four interconnected socket blocks 2.

Figure 3A:
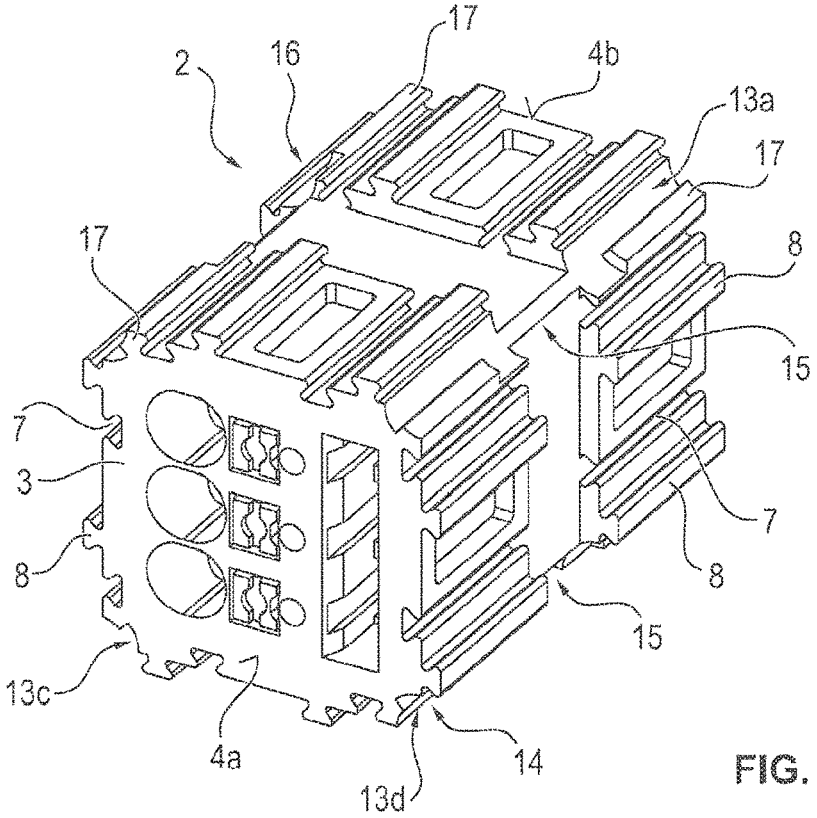
Figure 3B:
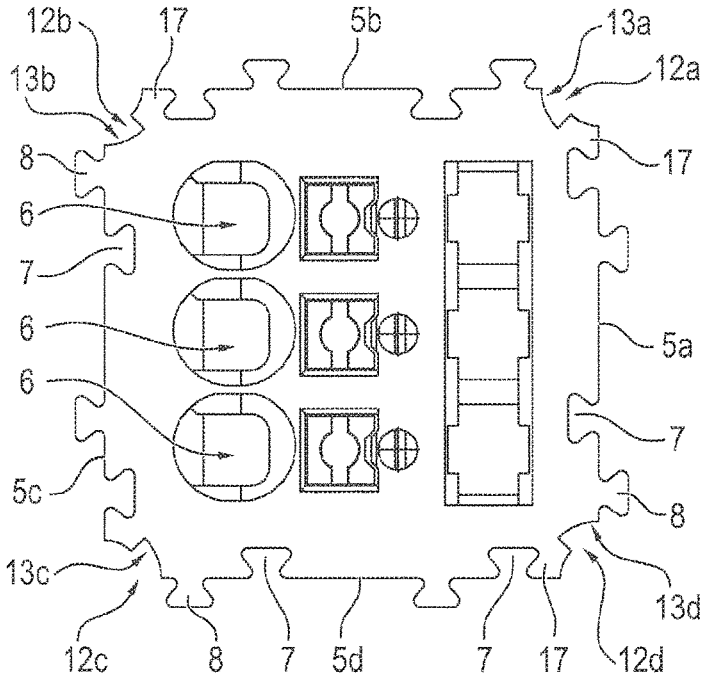

FIG. 3 shows that for this purpose on the four longitudinal edges 12*a*, 12*b*, 12*c*, 12*d* of a socket block 2 a respective groove 13*a*, 13*b*, 13*c*, 13*d* is formed which has a first section 14, a second section 15 which adjoins it in the longitudinal extension of the longitudinal edge 12, and a third section 16 which borders the second sections 15. In particular, it is apparent from a collective inspection of FIG. 1*b* and FIG. 3*b* that the cross section of the individual grooves 13 in the first section 14 corresponds to a quarter segment of the cross section of the pin 9. The third section 16 of the grooves 13 is also made accordingly, i.e., also in the third section 16 does the cross section of the grooves 13 each correspond to a quarter segment of the cross section of the pin 9. In contrast, the grooves 13 in the central second section 15 have a cross section which is so large that the pin 9 can be turned around its longitudinal axis when the pin 9 is located in the second section 15 of the grooves 13.

According to FIG. 2, the pin 9 has a core diameter D1 and an outside diameter D2 which is determined by the outside dimension of the teeth 10. In the second section 15 of the grooves 13 the diameter of the opening 11 which has been formed by the longitudinal edges 12 is at least as large as the outside diameter D2 of the pin 9.

The difference in the shape of the individual grooves 13*a*, 13*b*, 13*c*, 13*d* in the first section 14 and in the third section 16 from the shape of a quadrant is accomplished by a ridge 17 being made in the individual grooves 13*a*, 13*b*, 13*c*, 13*d* in the first section 14 and in the third section 16. The shape of the ridges 17 corresponds to the empty space between two adjacent teeth 10 of the pin 9 so that the ridges 17 each engage the empty spaces between two adjacent teeth 10 when the pin 9 is located in the first section 14 of the grooves 13*a*, 13*b*, 13*c*, 13*d* or the opening 11, as is apparent from FIG. 4.

Figure 4:
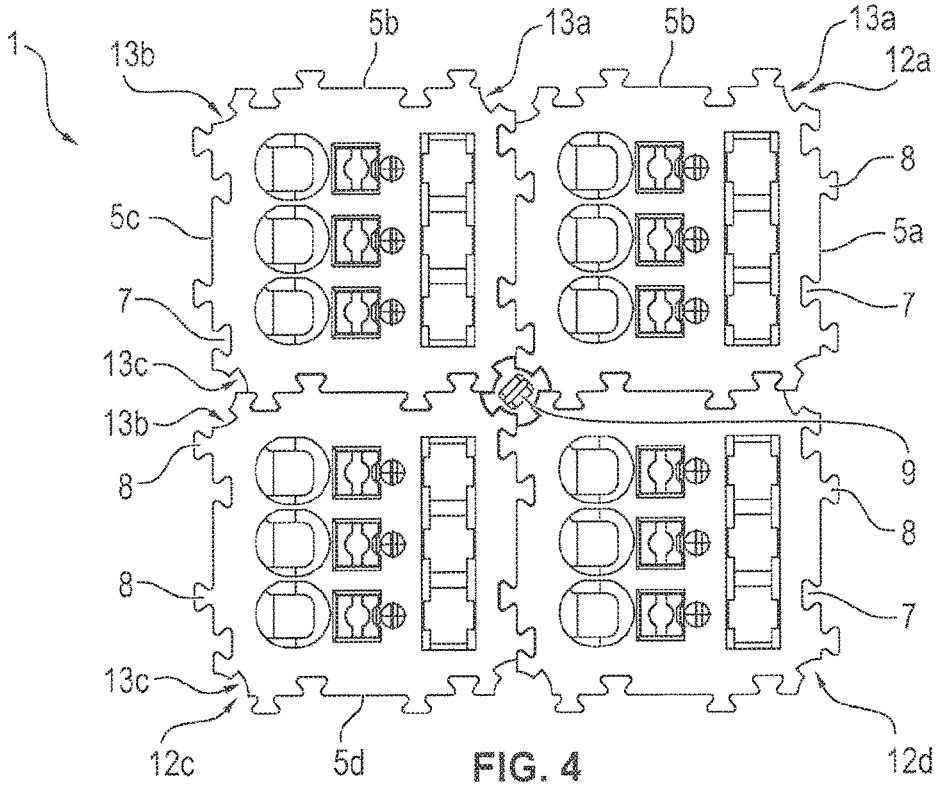
FIG. 4 is a front view of the patchboard according to FIG. 1, with an inserted pin in a first position.
Figure 5:
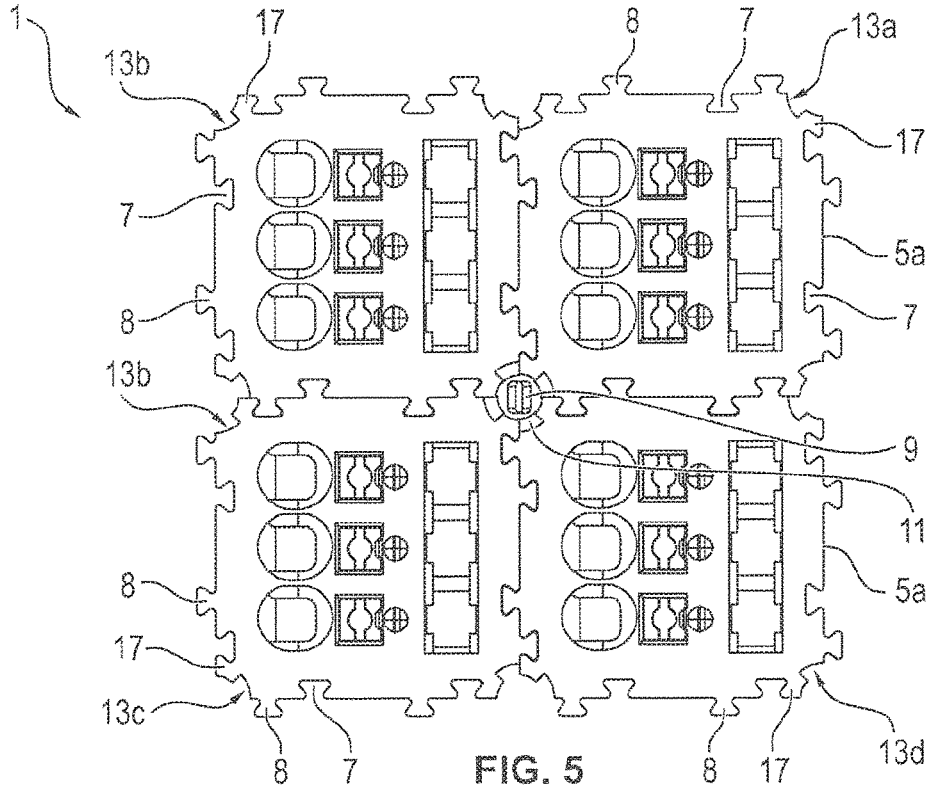
FIG. 5 is a front view of the patchboard according to FIG. 1, with an inserted pin in a second position.
Figure 6:
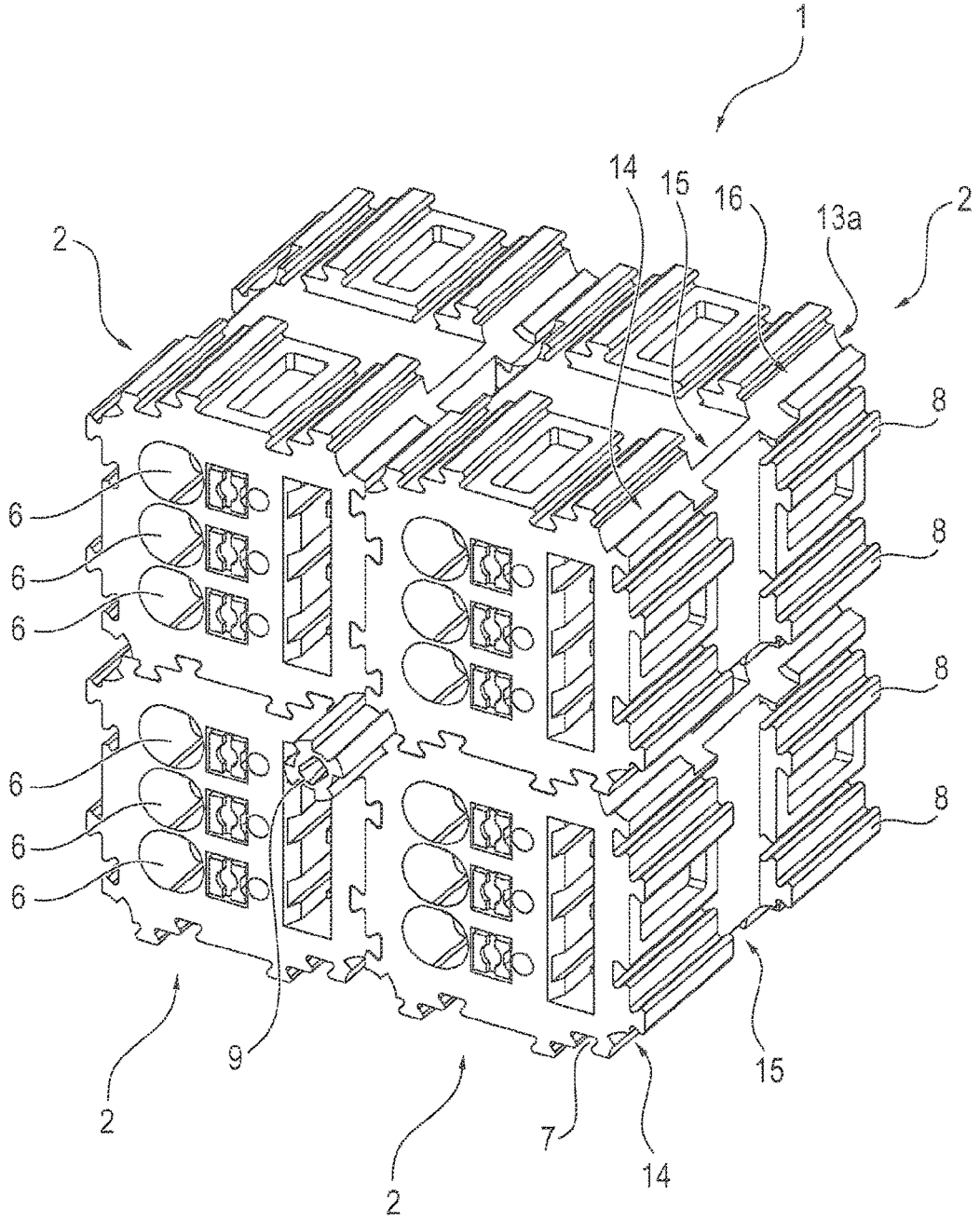
FIG. 6 is a perspective view of the patchboard according to FIG. 1, with a partially inserted pin.

If the pin 9 is pushed further the opening 11 out of the position shown in FIG. 4 and FIG. 6 so that it is located in the region of the second section 15 of the grooves 13, the pin 9 can be rotated by 45°, as is shown in FIG. 5. In this rotated position, the teeth 10 of the pin 9 are each located between the ridges 17 in the first section 14 and in the third section 16 of the individual grooves 13. This leads to the individual socket blocks 2 then also being fastened in the direction of the longitudinal extension of the side faces 5 and thus their no longer being able to be displaced relative to one another in the z direction.

If a socket block 2 is to be removed from the patchboard 1 because, for example, the socket block 2 is defective, by continuing to turn the pin 9 by 45° the interlocking in the z direction can be cancelled. The teeth 10 of the pin 9 are then no longer located between the ridges 17 in the first section 14 and the third section 16 of the individual grooves 13, but the pin 9 is located again correspondingly to the opening 11. In this way, a socket block 2 which is to be replaced can be easily pushed out of the patchboard 1 in the z direction or opposite the z direction without other socket blocks 2 having to be dismounted for this purpose.

Figure 7A:
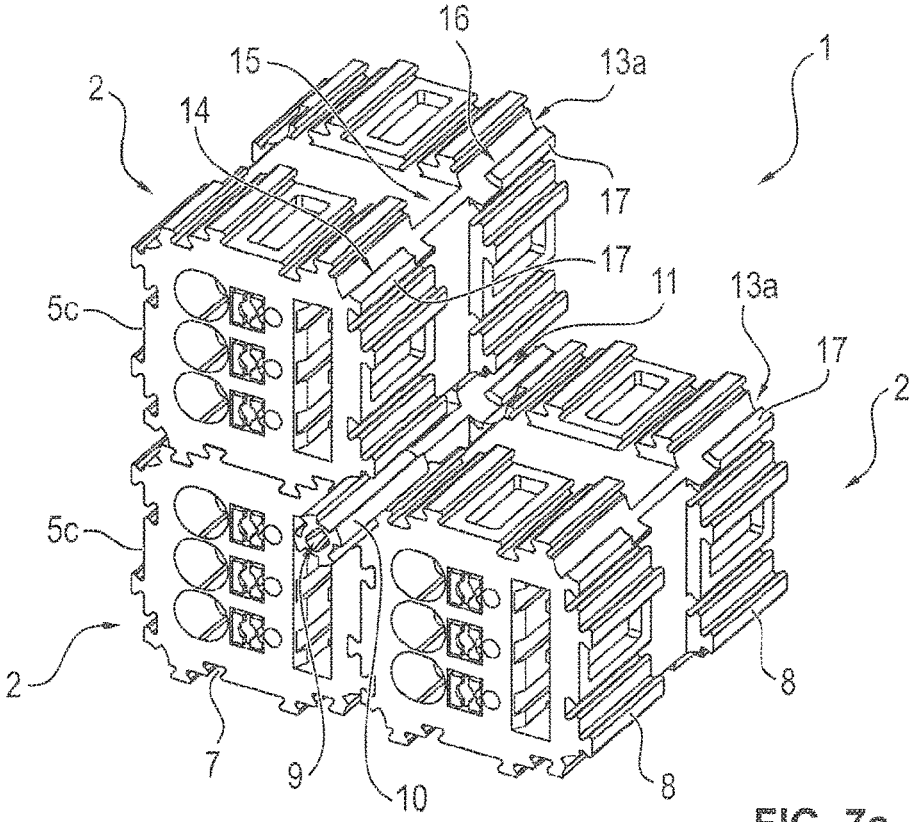
FIG. 7 is a perspective view showing three representations of a patchboard with three socket blocks and showing a pin in three different positions.
Figure 7B:
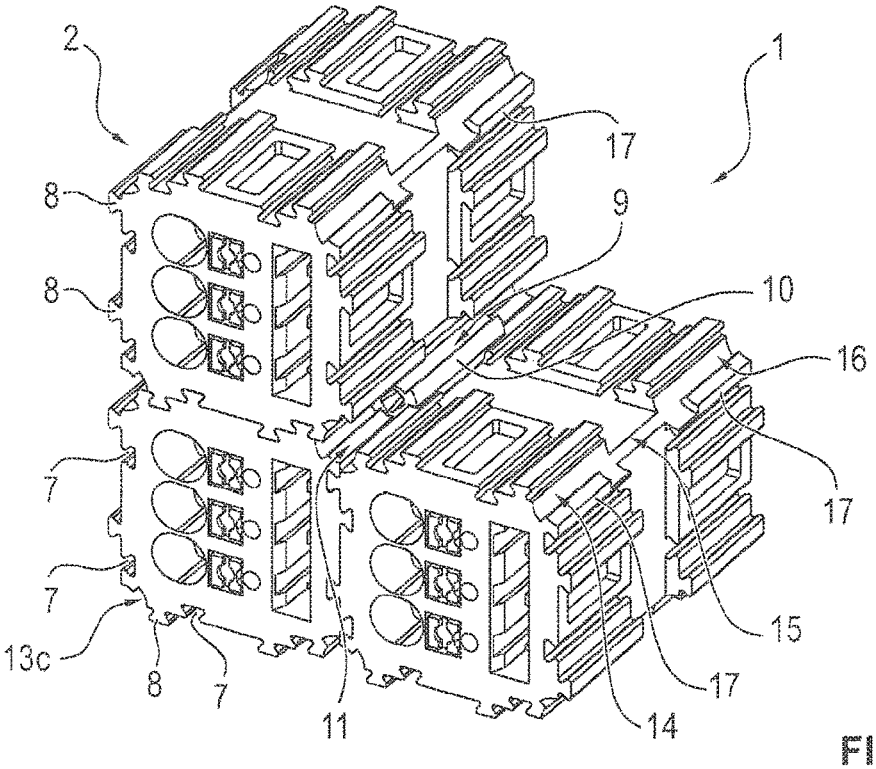
Figure 7C:
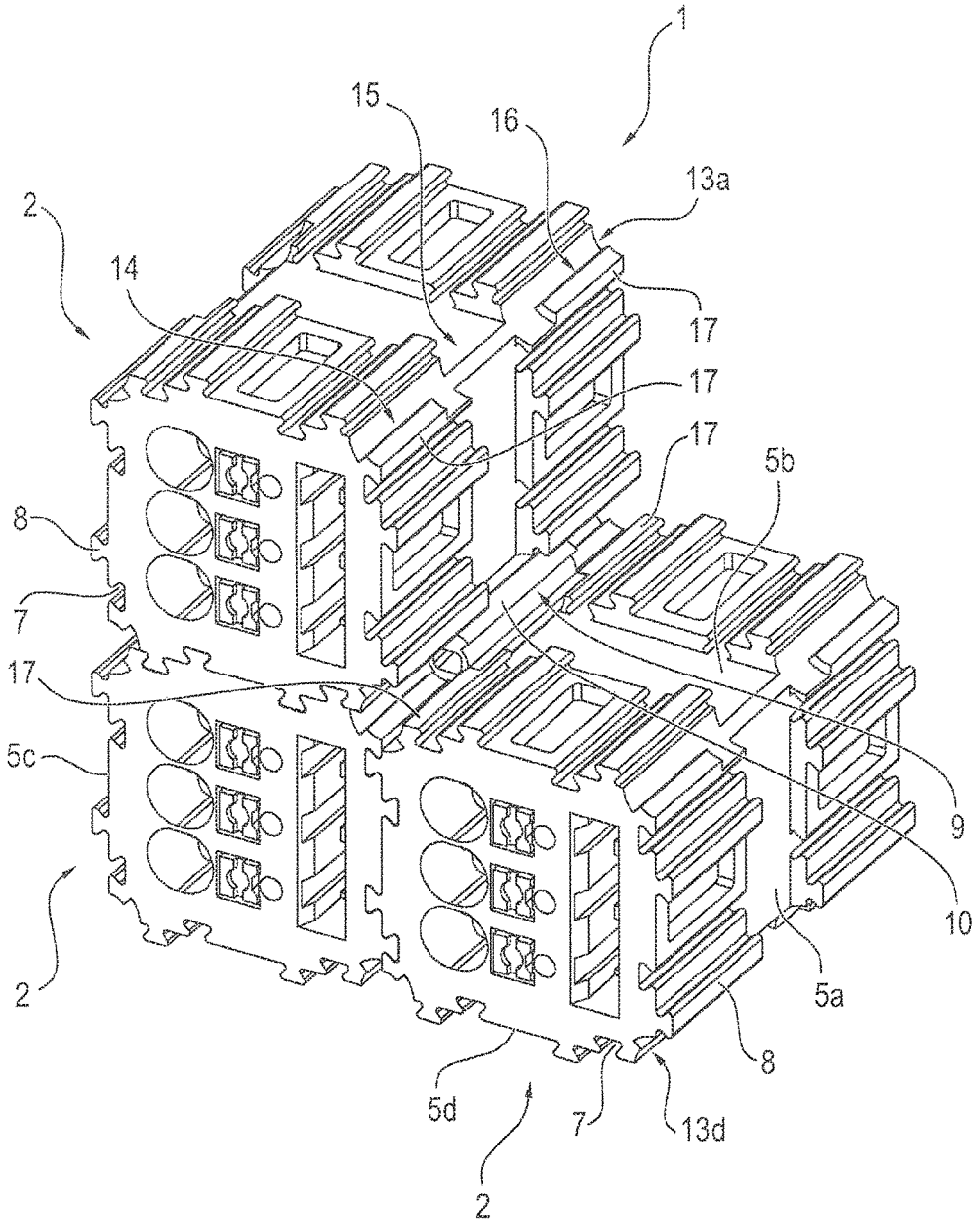

The above described procedure in the mounting of the patchboard 1 is also apparent from the representations of a patchboard 1 according to FIGS. 6 and 7. FIG. 6 shows a perspective of a patchboard 1 composed of four socket blocks 2 with a pin 9 which has been partially inserted into the opening 11. In FIGS. 7*a* to 7*c* conversely one socket block 2 is omitted so that the respective position of the pin 9 within the opening 11 is recognizable. FIG. 7*a* shows, according to FIG. 6, the pin 9 in the state only partially inserted.

In FIG. 7*b* the pin 9 is pushed so far into the opening 11 that it is located in the central second section 15 of the grooves 13. However, in this case, the orientation of the pin 9 is still such that no fastening of the socket blocks 2 in the z direction takes place. The socket blocks 2 can thus be displaced relative to one another in the direction of the longitudinal extension of their side faces 5. FIG. 7*c* conversely shows the pin 9 in the locking position, i.e., compared to the alignment according to FIG. 7*b* the pin 9 is now rotated by 45° around its longitudinal axis. The teeth 10 of the pin 9 lie in a line with the ridges 17 of the grooves 13 so that displacement of the socket blocks 2 relative to one another in the direction of the longitudinal extension of the pin 9 or in the z direction is prevented by the pin 9.

In a patchboard 1 composed in particular of four socket blocks 2, then the individual socket blocks 2 in all three directions of space are joined reliably and stably to one another so that a stable patchboard 1 is formed. At the same time, however, it is possible to easily dismount the patchboard 1 again, in particular to remove even individual socket blocks 2 from the existing patchboard 1 by the rotatable pin 9 being rotated again into a position in which the pin 9 can be pushed out of the opening 11 between the socket blocks 2 or the socket blocks 2 can be displaced relative to one another and to the pin 9 in the z direction.

Figure 8:
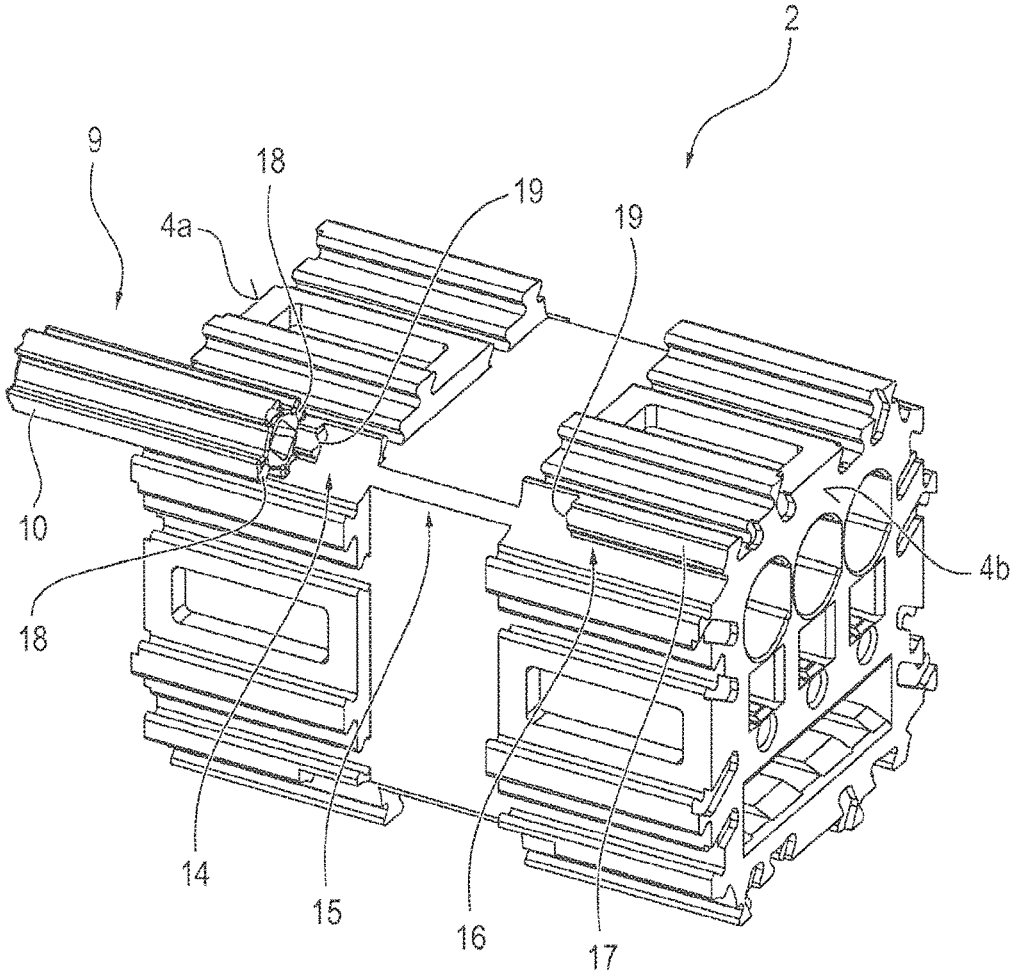
FIG. 8 is a perspective view of a second exemplary embodiment of a socket block with a pin.

FIGS. 8 and 9 show a version of the socket block which is shown in particular in FIG. 3 and of the pin 9 shown in FIG. 2. So that the pin 9 remains in its interlocking position rotated by 45° in the central second section 15, on the front ends of the teeth 10 of the pin 9 a respective catch recess 18 is made, as is apparent from FIG. 8. Corresponding thereto, on the front end of the ridge 17 facing the second section 15, there is a respective catch projection 19 both in the first section 14 and also in the third section 16 of the groove 13.

Figure 9A:
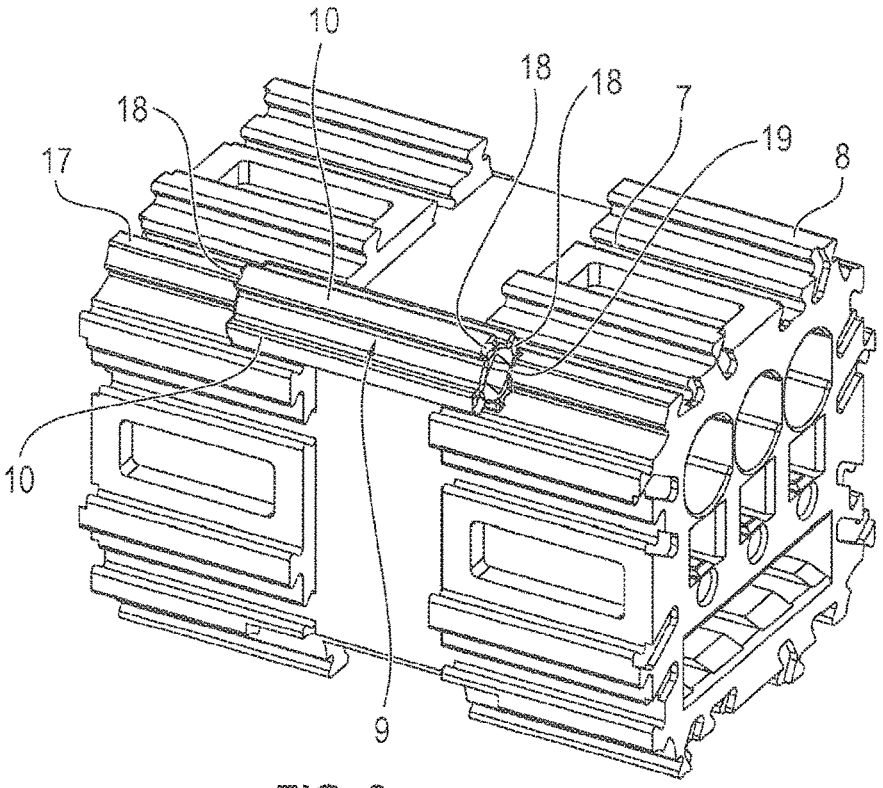
FIG. 9 shows two representations of the socket block according to FIG. 8, with the pin in two different positions.
Figure 9B:
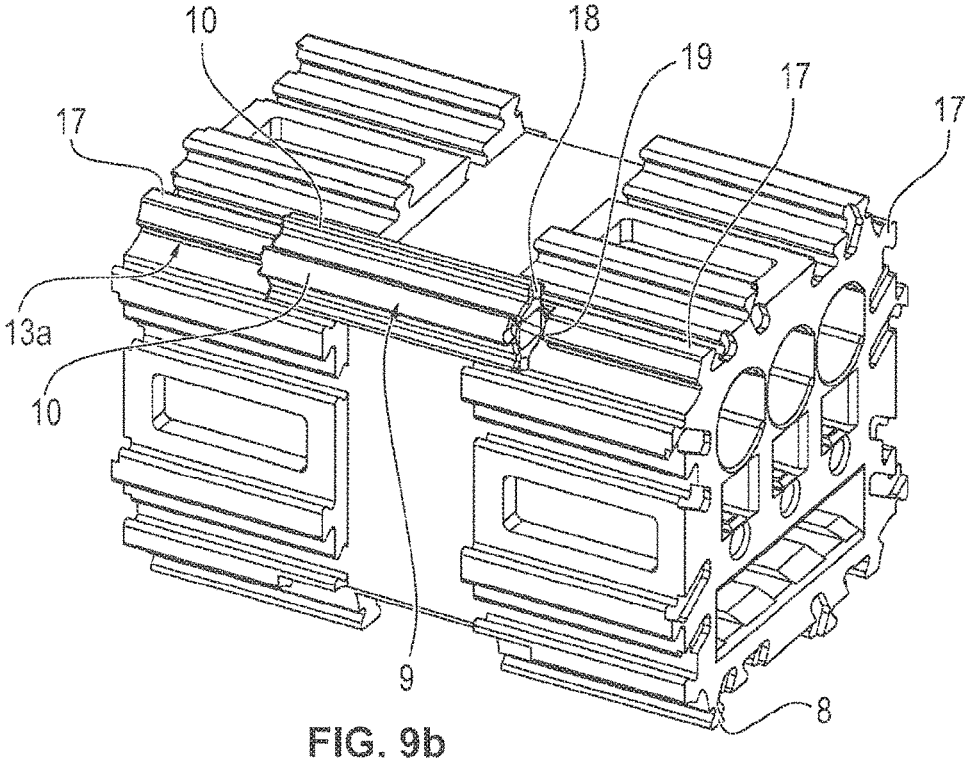

At this point, if the pin 9 according to FIG. 9 is in the second section 15 and then is rotated by 45° around its longitudinal axis out of the first orientation according to FIG. 9*a*, a respective catch projection 19 on a ridge 17 engages a catch recess 18 on an opposite tooth 10 of the pin 9 so that the pin is latched in the rotated position according to FIG. 9*b*. This prevents the pin 9 from rotating unintentionally around its longitudinal axis due to vibrations or shaking. Due to the relatively small size of the catch projections 19 and the flexibility of the material, in particular of the pin 9, but also of the housing 3, intentional rotation of the pin 9 is however possible, as before. For this purpose, in the front end of the pin 9 a recess 20 is formed for insertion of a tool, in particular the tip of a screwdriver.

Figure 10:
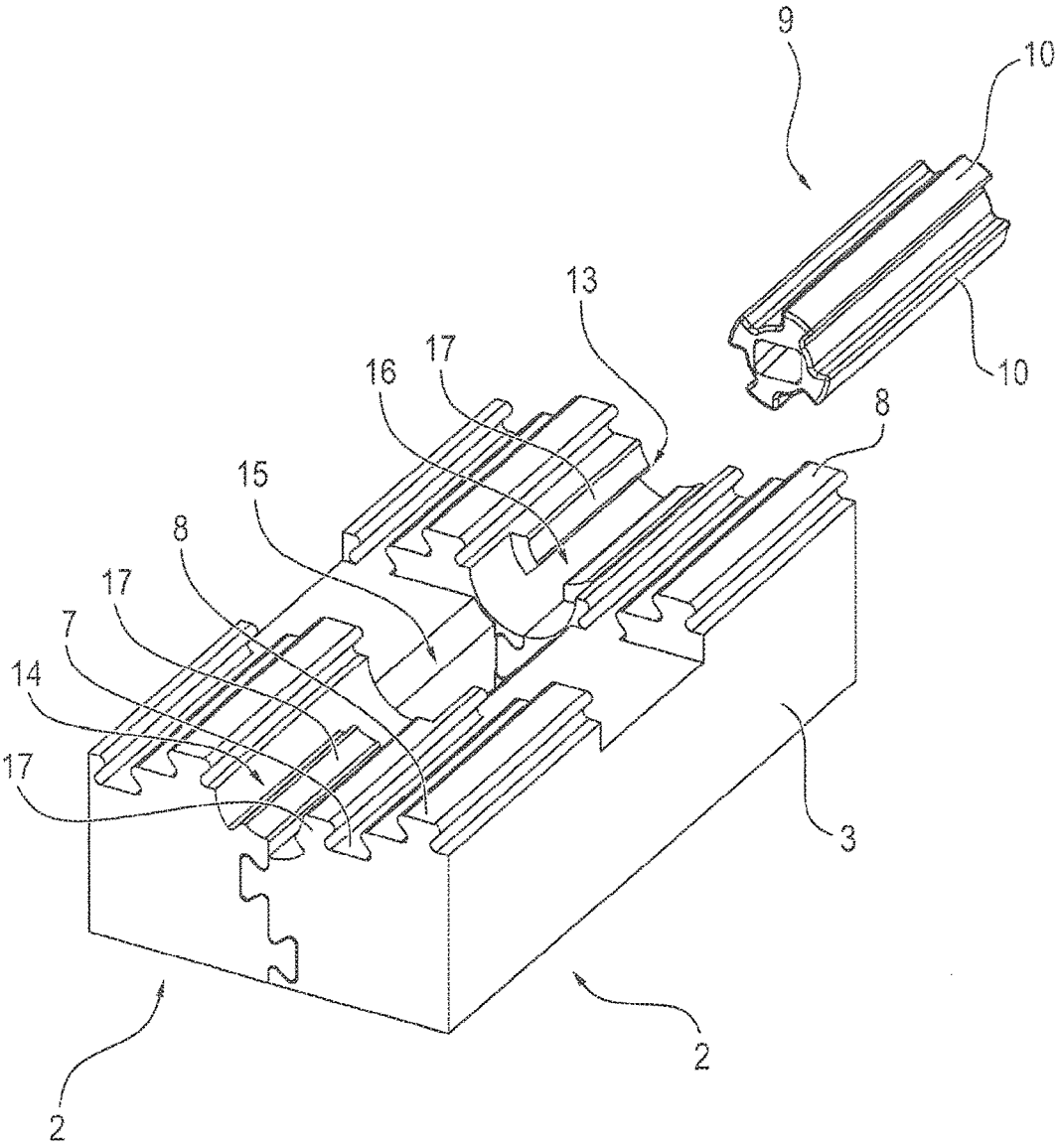
FIG. 10 shows an enlarged extract of two interconnected socket blocks and one pin.

FIG. 10 shows another version of a patchboard 1 in which the cross-sectional area of the third section 16 of a groove 13 is rotated relative to the cross-sectional area of the first section 14 of one groove 13. As is apparent from FIG. 10, the ridge 17 in the third section 16 of the groove 13 is rotated by roughly 45° relative to the ridge 17 in the first section 14 of the groove 13. This prevents a pin 9 from being pushed completely through the opening 11 with one motion.

Figure 11:
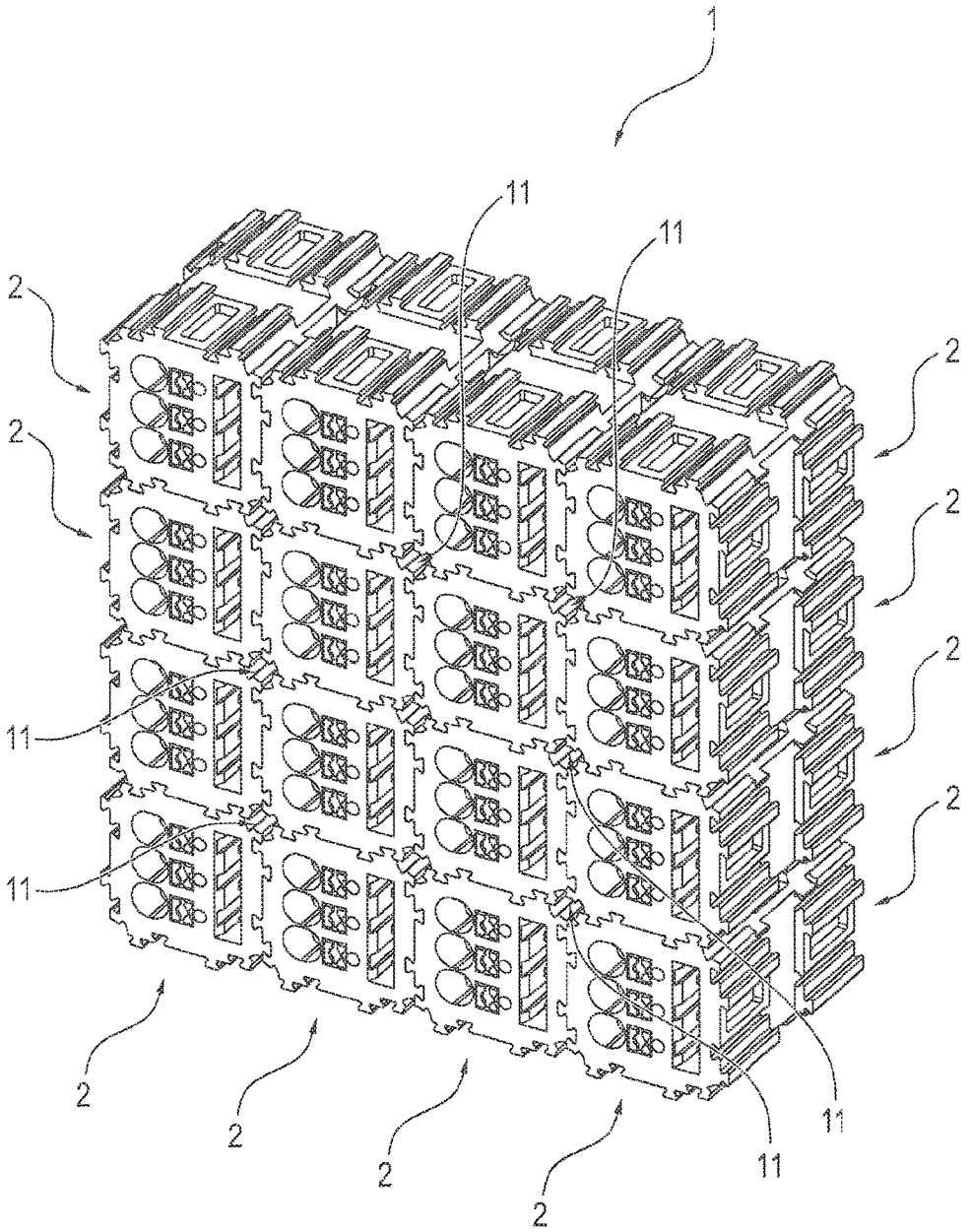
FIG. 11 shows a perspective of another exemplary embodiment of a patchboard assembled from a plurality of socket blocks.
Figure 12:
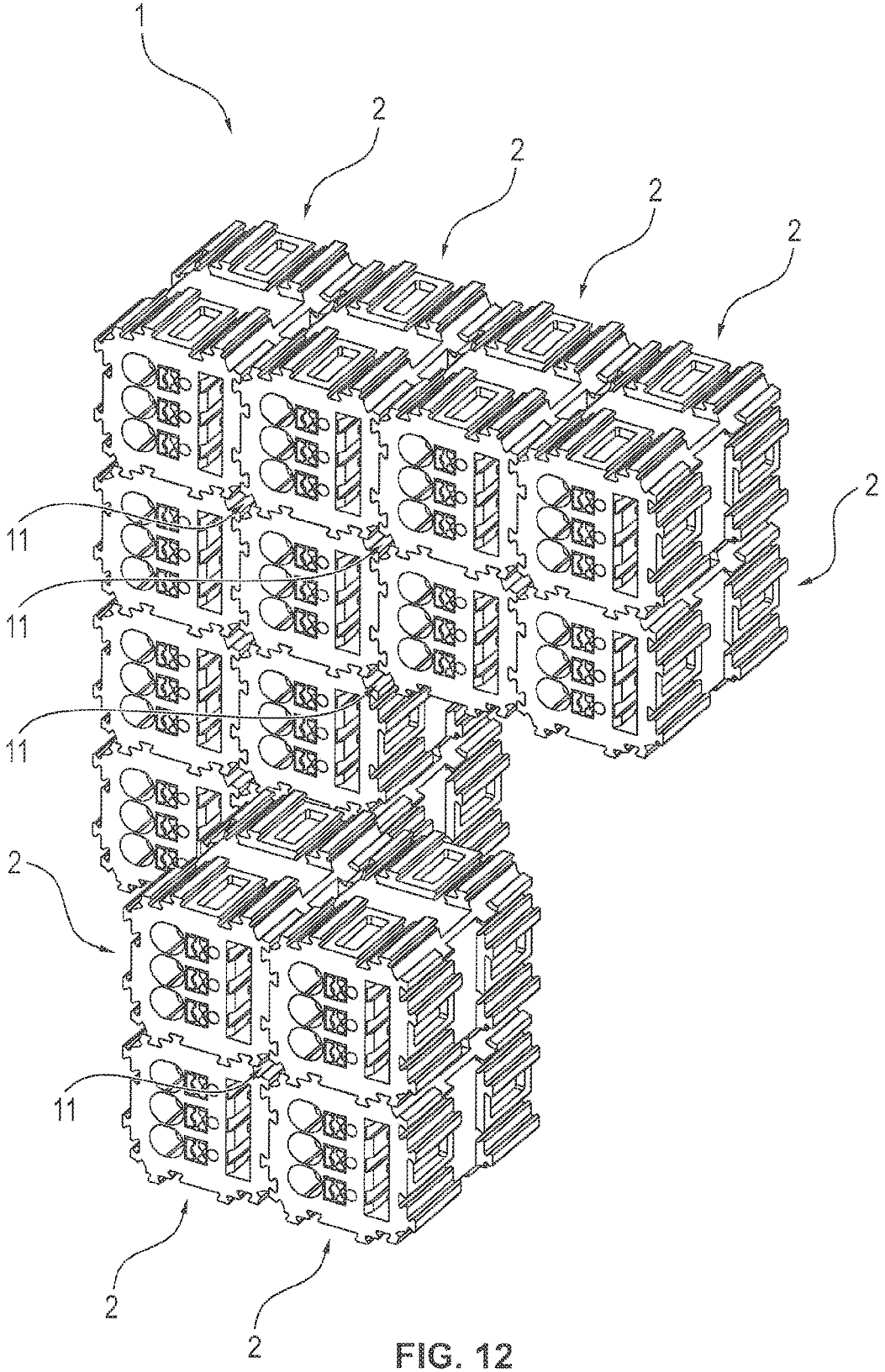
FIG. 12 shows the patchboard according to FIG. 11, in the partially dismounted state.

FIGS. 11 and 12 finally show another exemplary embodiment of a patchboard 1 with a larger number of socket blocks 2, the patchboard 1 according to FIG. 11 having a total of 16 socket blocks 2 which are located next to one another in four rows and on top of one another in four rows so that the patchboard 1 is altogether square, like the individual socket blocks 2. A total of 16 socket blocks 2 are fastened to one another in the z direction by a respective pin 9 being located in the center of four socket blocks 2 in the respective opening 11. The patchboard 1 in this case thus has nine openings 11 into which nine pins 9 are inserted. Since the pins 9 in the fully mounted state of the patchboard 1 are each located in the second center section 15 in the openings 11, the pins 9 are not visible in the perspective of the patchboard 1 according to FIG. 11.

It is apparent from FIG. 12 that by removing three pins 9 from the corresponding openings 11 simply one group of four socket blocks 2 which are still joined to and among one another can be separated from the remaining patchboard 1 by the four interconnected socket blocks 2 being displaced in the direction of the arrow X or being removed from the remaining patchboard 1.

What is claimed is:

1. A patchboard, comprising:

a plurality of socket blocks, each socket block having a box-shaped housing with two end faces, each of which has at least one connection region and four side faces, each of which extends between the end faces, the side faces having at least one connecting element for connection to another socket block, and at least one fastening element, wherein the individual socket blocks are arranged relative to one another such that each socket block is connected to at least one other socket block both in an x direction and also in a y direction, wherein the connecting elements, which are located on opposite side faces, being configured and arranged correspondingly to one another and the connecting elements each having a longitudinal extension which runs parallel to a longitudinal ex tension of the respective side face, wherein the fastening element is located in a center between four socket blocks and is in the shape of a pin with a gear-shaped cross section having four ridge-shaped teeth which run in the direction of a longitudinal axis of the pin, wherein on the four longitudinal edges of each socket blocks a respective groove is formed which has a first section and at least one second section which adjoins the first section in a longitudinal extension of the respective longitudinal edge and is at least as long as the pin, and wherein the cross section of each groove in the first section corresponds to a quarter segment of the cross section of the pin and the cross section of each groove in the second section is large enough so that the pin can be turned around its longitudinal axis when it is located in the second section.

2. The patchboard as claimed in claim 1, wherein the cross-sectional area of the third section of the grooves is rotated relative to the cross-sectional area of the first section of the grooves by 45°.

3. The patchboard as claimed in claim 1, wherein the teeth of the pin are dovetailed in cross section.

4. The patchboard as claimed in claim 1, wherein on each side face of the socket blocks at least one groove and at least one ridge corresponding to the groove are provided, the at least one groove on one side face being arranged mirror symmetrically to the ridge on an opposite side face and wherein the at least one ridge on the one side face is arranged mirror symmetrically to the groove on the opposite side face.

5. The patchboard as claimed in claim 1, wherein a recess for a tool is provided on the front end of the pin.

6. The patchboard as claimed in claim 1, wherein each of the grooves has a third section which adjoins the second section in the longitudinal extension of the longitudinal edge, the cross section of the grooves in the third section corresponds to a quarter segment of the cross section of the pin.

7. The patchboard as claimed in claim 6, wherein at least one tooth of the pin on at least one end has a catch recess or a catch projection, and wherein a catch projection or a catch recess is provided on a front end of the first section of at least one groove or on a front end of the third section of the at least one groove which end faces the second section.

* * * * *